US009199447B2

(12) United States Patent
Yamada

(10) Patent No.: US 9,199,447 B2
(45) Date of Patent: Dec. 1, 2015

(54) PRINTING APPARATUS AND PRINTING METHOD

(71) Applicant: SEIKO EPSON CORPORATION, Tokyo (JP)

(72) Inventor: Kazumi Yamada, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 13/759,867

(22) Filed: Feb. 5, 2013

(65) Prior Publication Data

US 2013/0215167 A1 Aug. 22, 2013

(30) Foreign Application Priority Data

Feb. 16, 2012 (JP) ..... 2012-031438

(51) Int. Cl.
*B41F 23/08* (2006.01)
*B41M 3/00* (2006.01)

(52) U.S. Cl.
CPC ..... *B41F 23/08* (2013.01); *B41M 3/008* (2013.01)

(58) Field of Classification Search
CPC ... H04N 1/407; H04N 1/405; H04N 1/40018; G06K 15/102; G01N 21/57
USPC ..... 347/15; 358/3.06–3.2; 427/494
See application file for complete search history.

(56) References Cited

U.S. PATENT DOCUMENTS

| | | | | |
|---|---|---|---|---|
| 7,490,917 | B2 * | 2/2009 | Hoshii | 347/6 |
| 2004/0227964 | A1 * | 11/2004 | Fujino | 358/1.9 |
| 2009/0244168 | A1 * | 10/2009 | Kakutani | 347/21 |
| 2010/0177357 | A1 * | 7/2010 | Yoshida | 358/3.21 |
| 2012/0113476 | A1 * | 5/2012 | Yoshida et al. | 358/2.1 |
| 2012/0262509 | A1 * | 10/2012 | Sakai et al. | 347/6 |

FOREIGN PATENT DOCUMENTS

JP 2010-076317 4/2010

* cited by examiner

*Primary Examiner* — Manish S Shah
*Assistant Examiner* — Renee I Wilson
(74) *Attorney, Agent, or Firm* — DLA Piper LLP (US)

(57) ABSTRACT

A printing apparatus that prints onto a printed object using a special glossy ink and a color ink includes a control unit that executes the print adding the special glossy ink to a region, in pixels of a night scene formed by the color ink, that is lighted.

7 Claims, 4 Drawing Sheets

PRINTING APPARATUS AND PRINTING METHOD

CROSS-REFERENCE TO RELATED APPLICATIONS

The entire disclosure of Japanese Patent Application No. 2012-31438, filed Feb. 16, 2012 is expressly incorporated by reference herein.

BACKGROUND

1. Technical Field

The present invention relates to printing apparatuses and printing methods.

2. Related Art

In recent years, printing techniques that use a special glossy ink, such as metallic ink, are being proposed. For example, the technique disclosed in JP-A-2010-76317 (see abstract) carries out printing that achieves both a sense of texture from a special glossy ink and color expressivity from color ink by specifying the color ink that is used the most when printing an image to be printed as a single primary ink; printing is executed after performing a halftone process through an ordered dithering method that continuously uses the same dither mask, so that when a metallic ink dot is "on", the primary ink dot is not "on", or in other words, so that the metallic ink dots and the primary ink dots do not overlap with each other.

When printing is carried out using a special glossy ink such as metallic ink, it is common to use a metallic plate for determining where and how much of the special glossy ink is to be added to the image to be printed, and the printing technique disclosed in JP-A-2010-76317 also executes printing based on a metallic plate configured by a user. Accordingly, past printing methods that use a special glossy ink have required the user to prepare a metallic plate him or herself before executing the print. Furthermore, even if the user has succeeded in creating a metallic plate by him or herself, there are cases where, depending on the scene expressed by image data, an optimal effect cannot be achieved using a single metallic plate.

SUMMARY

It is an advantage of some aspects of the invention to provide an image forming apparatus and an image forming method capable of forming image data with ease using a special glossy ink, without requiring a user to explicitly specify how the special glossy ink is to be applied to a scene expressed by an image to be printed.

An image forming apparatus according to an aspect of the present invention includes an image input unit that inputs image data configured of a plurality of pixels; a scene determination unit that determines a scene in the image data based on scene determination information contained as metadata of the image data inputted from the image input unit; a pattern selection unit that selects a single special glossy ink adding pattern from among a plurality of special glossy ink adding patterns in which are set the pixels to which a special glossy ink is to be added and the ink color of the special glossy ink in the pixels where the special glossy ink will be added, in accordance with the scene determined by the scene determination unit; an image processing unit that determines the pixels to which the special glossy ink is to be added based on the one special glossy ink adding pattern selected by the pattern selection unit; a color conversion unit that converts the image data in first color space information into image data expressed as second color space information, based on the image data inputted from the image input unit and information of pixels to which the special glossy ink is to be added determined by the image processing unit; and an image forming unit that generates print data based on the image data obtained through the color conversion performed by the color conversion unit. Through this, a single special glossy ink adding pattern that corresponds to the scene expressed by the image data is selected from among the plurality of special glossy ink adding patterns, and the locations to which the special glossy ink is to be added are determined automatically; accordingly, the image data can be formed using the special glossy ink with ease, without a user explicitly specifying how the special glossy ink is to be added to the scene expressed by the image to be printed.

In addition, the scene determination unit can determine the scene of the image data by referring to the scene determination information contained in an EXIF tag that serves as metadata of the image data; the pattern selection unit can select the special glossy ink adding pattern that corresponds to the scene indicated by the information contained in the EXIF tag as determined by the scene determination unit; and the image processing unit can detect a specific object included in the image data and determine the pixels to which the special glossy ink is to be added based on the special glossy ink adding pattern selected by the pattern selection unit, for the pixels contained in the specific object that has been detected. Through this, the pixels to which the special glossy ink is to be added can be determined for the specific object included in the image data based on the selected special glossy ink adding pattern; accordingly, the special glossy ink is added to locations in which a visual effect can easily be obtained in accordance with the scene expressed by the image data, and thus it is easier to obtain the visual effect from the special glossy ink.

In addition, an image forming method according to another aspect of the invention includes an image input step of inputting image data configured of a plurality of pixels; a scene determination step of determining a scene in the image data based on scene determination information contained in metadata of the image data inputted in the image input step; a pattern selection step of selecting a single special glossy ink adding pattern from among a plurality of special glossy ink adding patterns in which are set the pixels to which the special glossy ink is to be added and the ink color of the special glossy ink in the pixels where the special glossy ink will be added, in accordance with the scene determined in the scene determination step; an image processing step of determining the pixels to which the special glossy ink is to be added based on the one special glossy ink adding pattern selected in the pattern selection step; a color conversion step of converting the image data in first color space information into image data expressed as second color space information, based on the image data inputted in the image input step and information of pixels to which the special glossy ink is to be added determined in the image processing step; and an image forming step of generating print data based on the image data obtained through the color conversion step. Through this, a single special glossy ink adding pattern that corresponds to the scene expressed by the image data is selected from among the plurality of special glossy ink adding patterns, and the locations to which the special glossy ink is to be added are determined automatically; accordingly, the image data can be formed using the special glossy ink with ease, without a user explicitly specifying how the special glossy ink is to be added to the scene expressed by the image to be printed.

According to the invention, it is possible to provide an image forming apparatus and an image forming method capable of forming image data with ease using a special glossy ink, without requiring a user to explicitly specify how the special glossy ink is to be applied to a scene expressed by an image to be printed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
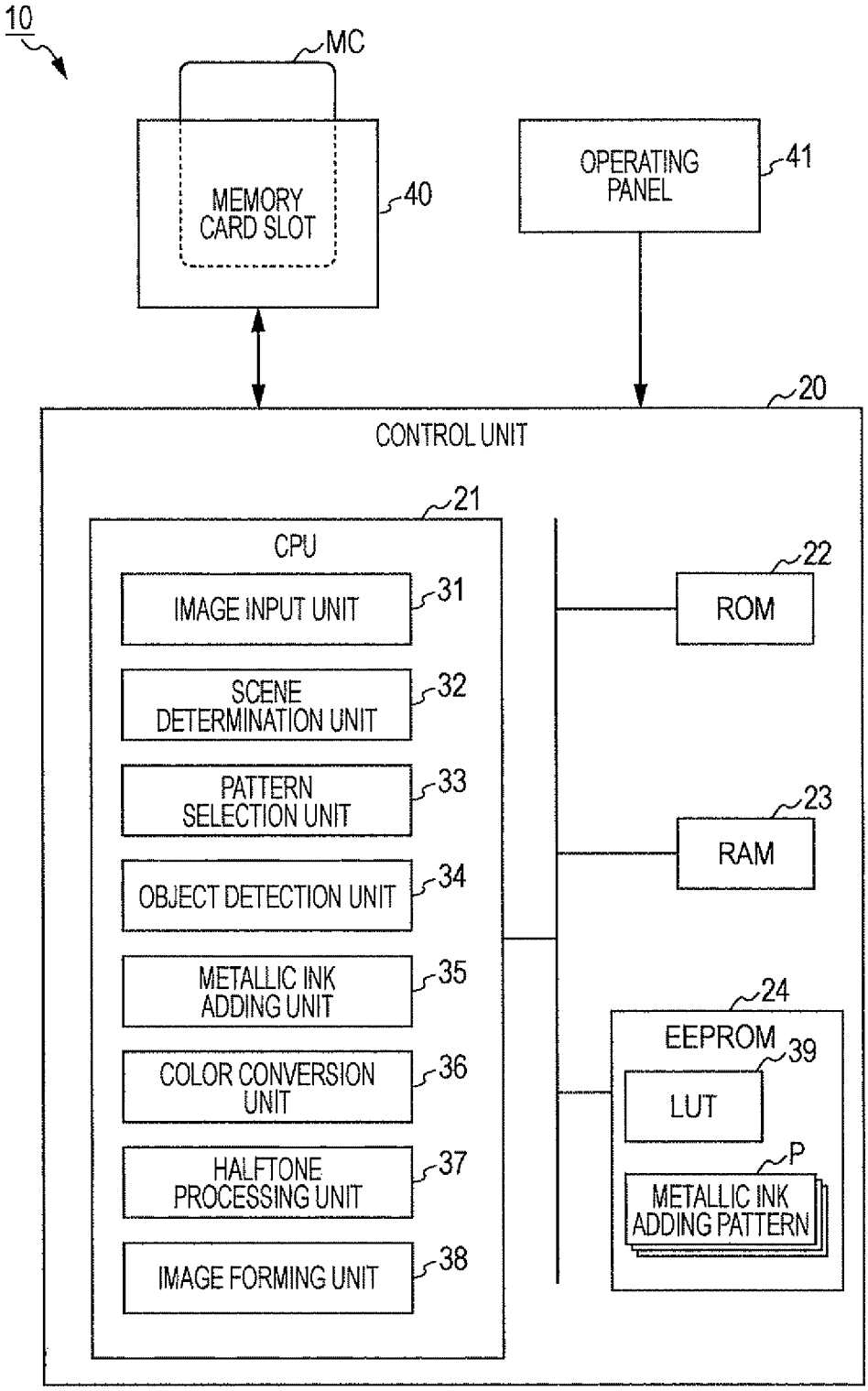
FIG. 1 is a block diagram illustrating an example of the configuration of a printer according to an embodiment of the invention.

Hereinafter, an embodiment of the invention will be described in detail with reference to the drawings. Note that a printer 10 described as an example of an image forming apparatus hereinafter is assumed to include a printing head (not shown) in which are installed color ink ink cartridges that hold cyan ink (C), magenta ink (M), yellow ink (Y), and black ink (Bk) as color inks and a metallic ink ink cartridge that holds metallic ink (S) serving as an example of a special glossy ink; the printer 10 is also assumed to carry out printing using both the color inks and the metallic ink. Note that "color ink" as referred to in this embodiment also includes black ink. However, black ink may also be excluded from the concept of "color ink".

"Metallic ink", meanwhile, is ink that expresses a metallic sense in the printed object, and, for example, an oil-based ink composition containing a metallic pigment, an organic solvent, and a resin can be used as such a metallic ink. In order to effectively produce a visual sense of being metallic, it is preferable for the stated metallic pigment to be realized as flat particles, and when the major axis of the flat particles is taken as X, the minor axis as Y, and the thickness as Z, it is preferable for a mean particle diameter R50 that is 50% of the equivalent diameter of a circle found based on the surface area of the X-Y plane of the flat particle to be 0.5 to 3 μm, and for R50/Z>5 to hold true. This metallic pigment can be formed from, for example, aluminum, an aluminum alloy, or the like, and can also be created by fracturing a metal deposited film. The concentration of the metallic pigment contained in the metallic ink can be set to, for example, 0.1 to 10.0 wt %. Of course, the metallic ink is not limited to this composition, and any other composition can be employed as appropriate as long as it is a composition that is capable of producing a metallic sense. For example, a dye ink in which ink ejected onto a print medium permeates into an ink absorption layer and expresses color through the ink absorption layer, may be used.

In this embodiment, the composition of the metallic ink is as follows: aluminum pigment, 1.5 wt %; glycerin, 20 wt %; triethylene glycol monobutyl ether, 40 wt %; BYK-UV3500 (manufactured by BYK Japan KK), 0.1 wt %.

In addition, "pixel" as referred to hereinafter typically indicates a "pixel" in image data, but may also indicate a "pixel" in a printed image that is the result of printing. Furthermore, "image" as referred to hereinafter typically indicates all or part of a printed image that is the result of printing, but may also indicate part or all of a piece of "image data".

Further still, although the following describes the image forming apparatus as being configured only of the printer 10, a program (a printer driver) for causing the printer 10 to execute a printing process may be installed in a personal computer (not shown), and these devices may collectively configure a single image forming apparatus. The program mentioned here may also include an application program in addition to the printer driver.

Overview of Printer 10

FIG. 1 is a block diagram illustrating the overall configuration of the printer 10 that embodies an image forming apparatus according to the invention. This printer 10 includes a control unit 20. The control unit 20 is configured so as to include a CPU 21, a ROM 22, a RAM 23, and an EEPROM 24 that are connected to each other via a bus. Furthermore, by expanding programs stored in the ROM 22, the EEPROM 24, and so on in the RAM 23 and executing the programs, the control unit 20 also functions as an image input unit 31, a scene determination unit 32, a pattern selection unit 33, an object detection unit 34, a metallic ink adding unit 35, a color conversion unit 36, a halftone processing unit 37, and an image forming unit 38. Details of these functional units will be given later. An LUT (look-up table) 39 for converting RGB tone values and metallic ink addition information SA (an example of pixel information) into respective CMYK and metallic ink S tone values, and a plurality of metallic ink adding patterns P corresponding to scenes in image data ORG, are stored in the EEPROM 24.

A memory card slot 40 is connected to the control unit 20, and the image data ORG can be loaded and inputted from a memory card MC that has been inserted into the memory card slot 40. In this embodiment, the image data ORG inputted from the memory card MC is data configured of three color components, or red (R), green (G), and blue (B). Note that the image data ORG inputted to the control unit 20 need not be loaded from the memory card MC, and may be loaded from a digital still camera, a personal computer, a USB memory, or the like instead.

In addition, the control unit 20 can receive an instruction from a user through an operating panel 41 or the like and determine whether or not to add a metallic color to the inputted image data ORG. Upon receiving an instruction to add a metallic color from the user, the control unit 20 can determine, based on a predetermined determination standard, pixels or a region configured of the metallic color (called a "metallic region" hereinafter) that is separate from pixels or regions configured of one of the respective R, G, and B color components (called "color regions" hereinafter). Note that the metallic regions and color regions may overlap or may not overlap (an overlapping region will be referred to as a "metallic color region"). In addition, dots formed by color ink and dots formed by the metallic ink within the same region may be printed in a mixed manner, or the color ink and the metallic ink may be printed individually, independent from each other.

The printer 10 configured as described above can, for the image data ORG inputted from the memory card MC, automatically determine locations on a print medium where a metallic color is to be added in the case where the user wishes to print using a metallic color in accordance with a scene in the image data ORG, and can form image data using the metallic color and print that image data with ease.

Printing Process

Figure 2:
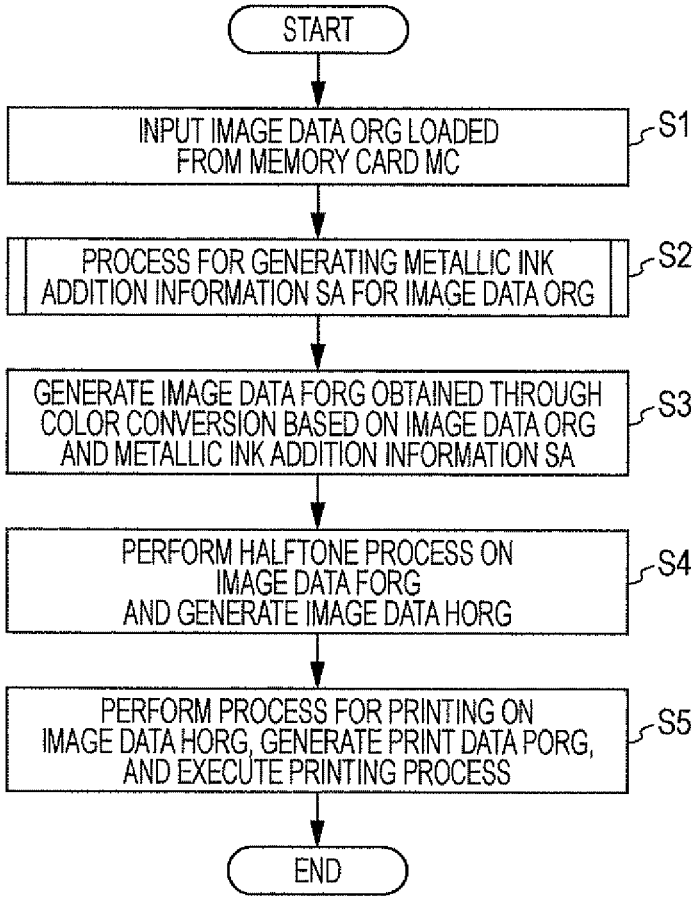
FIG. 2 is a flowchart illustrating a printing process executed by a control unit.

Next, a printing process performed by the printer 10 will be described. FIG. 2 is a flowchart illustrating a printing process executed by the control unit 20 of the printer 10 illustrated in FIG. 1. Note that this printing process is started, for example, in response to an instruction being received from the user via the operating panel 41 or the like.

In step S1, the image input unit 31 of the control unit 20 inputs the image data ORG loaded from the memory card MC. Specifically, the image input unit 31 inputs the loaded image data ORG into the scene determination unit 32.

In step S2, the scene determination unit 32, the pattern selection unit 33, the object detection unit 34, and the metallic ink adding unit 35 of the control unit 20 generate the metallic ink addition information SA for the image data ORG. Note that the specific process for generating the metallic ink addition information SA for the image data ORG will be described later. The image data ORG and the metallic ink addition information SA are supplied to the color conversion unit 36.

In step S3, the color conversion unit 36 of the control unit 20 generates image data FORG from the image data ORG and the metallic ink addition information SA by referring to the LUT 39. Specifically, the color conversion unit 36 refers to the LUT 39 and generates the so-called metallic plate by converting the metallic ink addition information SA generated in the process of step S2 into pixels to which the metallic ink S is to be added and tone values corresponding to the ink color of the metallic ink S, and refers to the LUT 39 and converts the image data ORG from the RGB color system into color inks that can be expressed by the printer 10. In other words, in step S3, the image data FORG is generated using color space information (color ink and metallic ink) that can be expressed by the printer 10. The image data FORG is then supplied to the halftone processing unit 37.

In step S4, the halftone processing unit 37 of the control unit 20 performs a halftone process on the image data FORG, and generates image data HORG. Specifically, the halftone processing unit 37 generates the image data HORG by performing a process that uses a dot distribution to set the dots in each ink color to "on" or "off" according to the respective tone values indicated by the image data FORG that has been color-converted by the color conversion unit 36. Note that the process executed by the halftone processing unit 37 can employ a known dithering method, an error diffusion method, a density pattern method, or the like. The image data HORG is then supplied to the image forming unit 38.

In step S5, the image forming unit 38 of the control unit 20 carries out a process for printing on the image data HORG, generates print data PORG, and executes a printing process. Specifically, the image forming unit 38 generates the print data PORG by rearranging the arrangement of the image data HORG into an order that is to be transferred to a printing head (not shown) of the printer 10, and executes the printing process.

Figure 3:
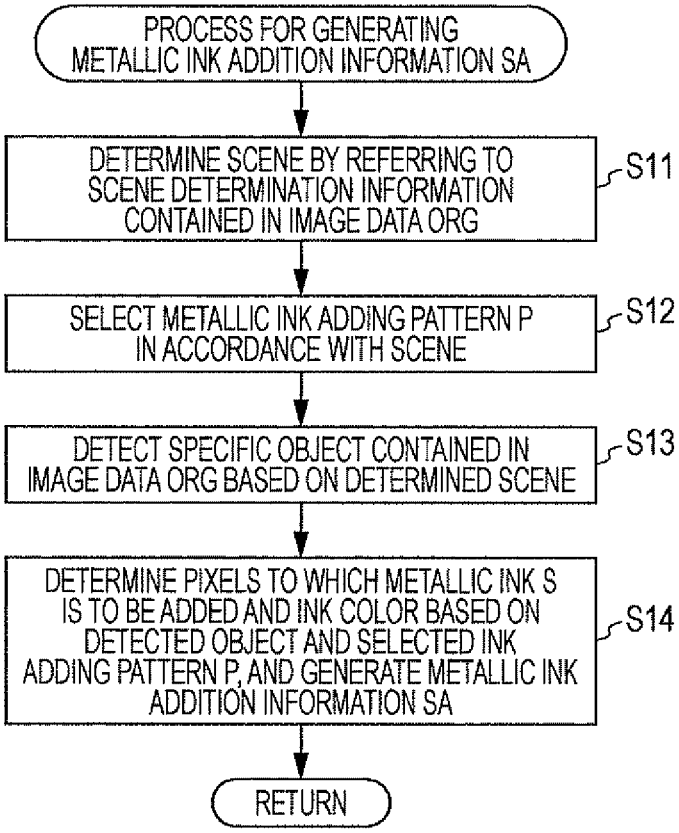
FIG. 3 is a flowchart illustrating a process for generating metallic ink addition information.

FIG. 3 is a flowchart illustrating details of the process for generating the metallic ink addition information SA in step S2 of FIG. 2. In step S11, the scene determination unit 32 of the control unit 20 determines a scene in the image data ORG by referring to scene determination information contained in metadata of the image data ORG. For example, the scene determination unit 32 refers to scene determination information (for example, a night scene, a sunset scene, a portrait, or the like) included in an EXIF (exchangeable image file format) tag of the image data, and determines the scene expressed by the image data ORG. Note that the scene determination unit 32 may determine the scene based on an image feature amount of the image data ORG.

In step S12, the pattern selection unit 33 of the control unit 20 selects a metallic ink adding pattern P in accordance with the scene determined in step S11.

In step S13, the object detection unit 34 detects a specific object contained in the image data ORG based on the scene analyzed by the scene determination unit 32. In the case where, for example, the scene in the image data ORG analyzed by the scene determination unit 32 is a night scene, the object detection unit 34 detects the presence/absence of a region including stars, the moon, neon signage, or the like as objects included in a night scene. Note that any method may be used as the method for detecting an object, and the object may be detected using a known image recognition technique, such as pattern matching, a statistical identification method, a structure identification method, or the like.

In step S14, the metallic ink adding unit 35 determines pixels to which the metallic ink is to be added and an ink color of the metallic ink in the case where the metallic ink is to be added, based on the object detected by the object detection unit 34 and the metallic ink adding pattern P selected by the pattern selection unit 33. For example, the metallic ink adding unit 35 sets a flag for adding the metallic ink in the pixels contained within the contours of the detected object, and sets the ink color of the metallic ink S so that the ink color of the metallic ink S lightens the further away the pixel is from the pixel that has the highest brightness or color value, or in other words, so that a gradation is formed. Then, the metallic ink adding unit 35 supplies, to the color conversion unit 36, information indicating the pixels in which the flag for adding the metallic ink S has been set and the ink color of the metallic ink S for each pixel in which the flag for adding the metallic ink S has been set (that is, the metallic ink addition information SA). Because the metallic ink addition information SA is automatically generated in accordance with the scene and the object in the image data ORG in this manner, it is not necessary for the user to explicitly specify the locations to which the metallic ink S is to be added.

Example of Printed Image

Figure 4:
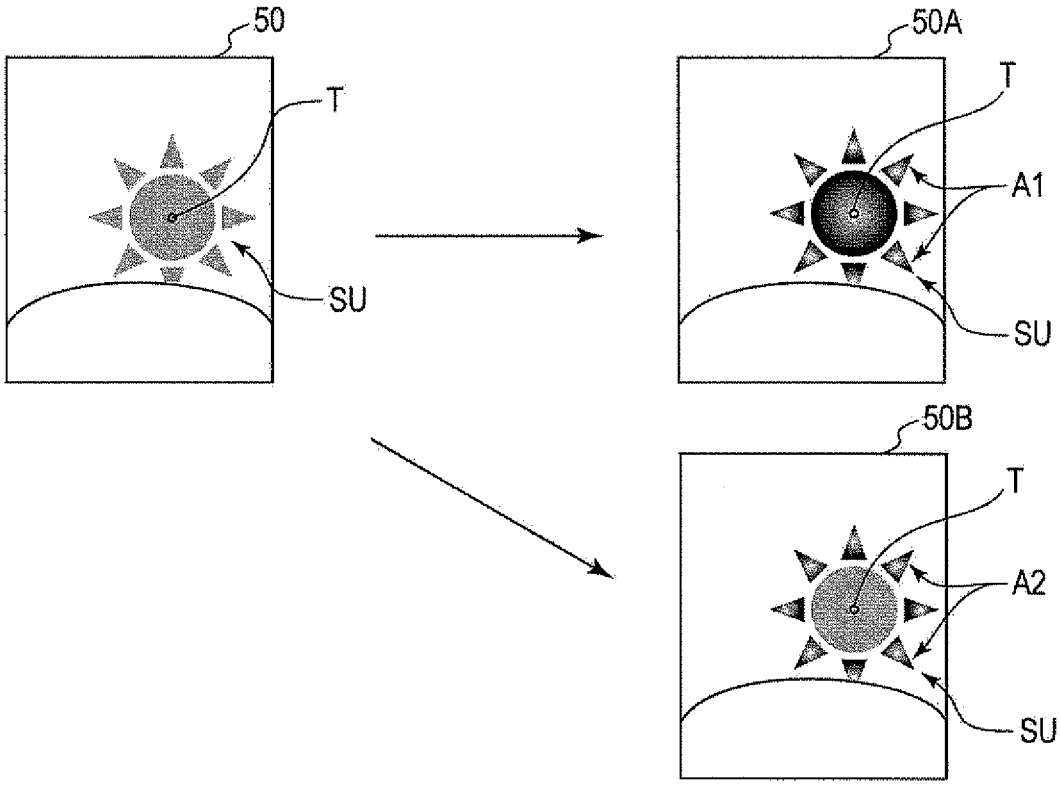
FIG. 4 is a diagram illustrating an example of an image to which metallic ink has been added.

FIG. 4 illustrates an example of an image printed as the result of a printing process executed by the printer 10 shown in FIG. 1. An image 50 shown in FIG. 4 is a landscape picture illustrating a sunset scene. For example, if the scene determination unit 32 determines that the image 50 is a sunset scene based on the EXIF tag information in the original image data of the image 50, the pattern selection unit 33 selects a metallic ink adding pattern P for a sunset scene. The metallic ink addition information SA that is preferable for objects such as the sun, the moon, and so on is registered in the metallic ink adding pattern P selected for use in a sunset scene by the pattern selection unit 33. In other words, the metallic ink adding unit 35 adds the metallic ink S that is effective for sunset scenes in a range in which a sun SU, which has been detected by the object detection unit 34, is rendered. Specifically, in the image 50 shown in FIG. 4, pixels of the sun SU, which serves as the object, that are contained within a predetermined range from a center point T are set as pixels to which the metallic ink S is to be added, and the ink color of the metallic ink S is also determined. As a result, as indicated by an image 50A, a gradation is produced in the circle formed in the central area of the sun SU by reducing the ink color of the metallic ink S as the distance from the center point T increases; in parts A1 of the sun SU (that is, the triangular regions formed in the periphery of the central area of the sun SU), gradations are produced in those respective regions. Note that the metallic ink S may be added to pixels in specific locations of the sun SU, which serves as the object (for example, in parts A2 in the periphery of the sun SU), as indicated by an image 50B. In this manner, it is possible to add the metallic ink S to locations where it is desirable to add a metallic color, in accordance with the scene indicated by the EXIF tag information of the image data.

Figure 5:
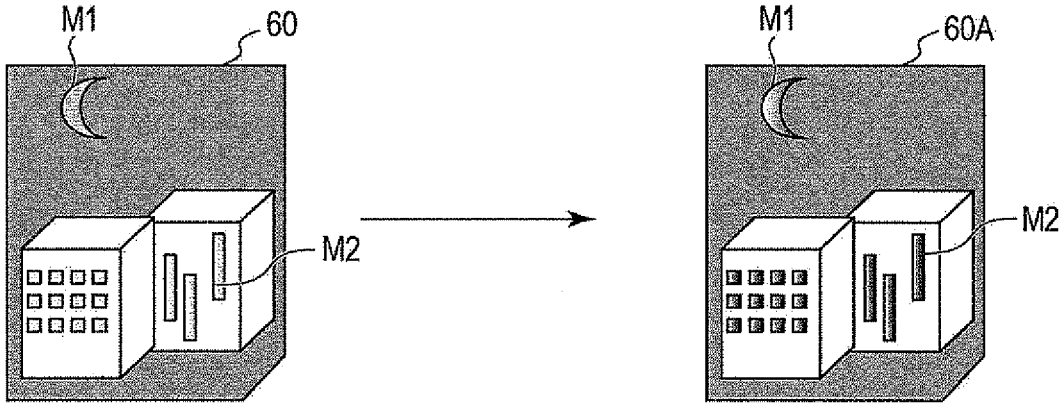
FIG. 5 is a diagram illustrating an example of an image to which metallic ink has been added.

FIG. 5 illustrates an example of an image printed as the result of a printing process executed by a printer according to another embodiment. An image 60 shown in FIG. 5 is a cityscape illustrating a night scene. For example, if the scene determination unit 32 determines that the image 60 is a night scene based on the EXIF tag information in the original image data of the image 60, the pattern selection unit 33 selects a metallic ink adding pattern P for a night scene. With the metallic ink adding pattern P selected by the pattern selection unit 33 for the night scene, the metallic ink adding unit 35 effectively adds the metallic ink S to regions in the night scene detected by the object detection unit 34 that are lighted. For example, in the image 60 shown in FIG. 5, the interior of a region forming a crescent moon M1 and the interior of regions M2 that form the windows of buildings are present as regions in the night scene that are lighted; the pixels included in those regions are thus determined to be pixels to which the metallic ink S is to be added. As a result, an image 60A, in which the metallic ink S is added to the interior of the region that forms the crescent moon M1 and the interior of the regions M2 that form the windows of the buildings, is formed. In this manner, it is possible to automatically add the metallic ink S only to locations in which it is desirable to add a metallic color, based on the EXIF tag information in the original image data of the image 60 indicating a night scene. It is particularly difficult, even when using the metallic ink S, to elicit a metallic sense for pixels that configure a background, which is a region of a night scene in which the brightness is not high, as indicated by the image 60; accordingly, the metallic ink S is not used for pixels included in such regions, which makes it possible to keep costs down.

Effects of the Embodiment of the Invention

As described thus far, the printer 10 according to this embodiment includes the image input unit 31 that inputs the image data ORG configured of a plurality of pixels; the scene determination unit 32 that determines a scene in the image data ORG based on scene determination information contained in metadata of the image data ORG inputted from the image input unit 31; the pattern selection unit 33 that selects a single metallic ink adding pattern P from among the plurality of metallic ink adding patterns P (special glossy ink adding patterns) in which are set the pixels to which the metallic ink S (special glossy ink) is to be added and the ink color of the metallic ink S in the pixels where the metallic ink S will be added, in accordance with the scene determined by the scene determination unit 32; the metallic ink adding unit 35 (image processing unit) that determines the pixels to which the metallic ink S is to be added based on the one metallic ink adding pattern P selected by the pattern selection unit 33; the color conversion unit 36 that converts the image data ORG in the RGB color system serving as the first color space information into the image data FORG expressed as the CMYK color system and a metallic color that serve as second color space information, based on the image data ORG and the metallic ink addition information SA (the information of pixels to which the metallic ink S is to be, added) determined by the metallic ink adding unit 35; and the image forming unit 38 that generates the print data PORG based on the image data HORG obtained by performing a halftone process on the image data FORG obtained through the color conversion performed by the color conversion unit 36. Accordingly, image data that uses the metallic ink S can be formed with ease without specifying where the metallic ink S is to be added, in accordance with the scene expressed by the image to be printed. In addition, because the metallic ink S is automatically used in locations where it is preferable to express a metallic sense in accordance with the scene expressed by the image to be printed, it is possible to obtain a visual effect (an appearance of metal) while suppressing costs more than in the case where the metallic ink S is used without regard for the scene expressed by the image to be printed.

In addition, the scene determination unit 32 determines the scene of the image data ORG by referring to the scene determination information contained in the EXIF tag that serves as the metadata of the image data ORG; the pattern selection unit 33 selects the metallic ink adding pattern P that corresponds to the scene indicated by the information contained in the EXIF tag as determined by the scene determination unit 32; and the object detection unit 34 (image processing unit) detects a specific object included in the image data ORG and determines the pixels to which the metallic ink S is to be added based on the metallic ink adding pattern P selected by the pattern selection unit 33, for the pixels contained in the specific object that has been detected. Through this, the pixels to which the metallic ink S is to be added can be determined based on the metallic ink adding pattern P selected for the specific object included in the image data ORG; accordingly, the metallic ink S is added to locations where a visual effect (an appearance of metal) can easily be obtained in accordance with the scene expressed by the image data ORG, which makes it easier to obtain the visual effect (the appearance of metal) using the metallic ink S.

In addition, an image forming method for the aforementioned printer 10 includes an image input step of the image input unit 31 inputting the image data ORG configured of a plurality of pixels; a scene determination step of the scene determination unit 32 determining a scene in the image data ORG based on scene determination information contained in metadata of the image data ORG inputted in the image input step; a pattern selection step of the pattern selection unit 33 selecting a single metallic ink adding pattern P from among the plurality of metallic ink adding patterns P (special glossy ink adding patterns) in which are set the pixels to which the metallic ink S (special glossy ink) is to be added and the ink color of the metallic ink S in the pixels where the metallic ink S will be added, in accordance with the scene determined in the scene determination step; a metallic ink adding step (image processing step) of the metallic ink adding unit 35 determining the pixels to which the metallic ink S is to be added based on the one metallic ink adding pattern P selected in the pattern selection step; a color conversion step of the color conversion unit 36 converting the image data ORG in the RGB color system serving as the first color space information into the image data FORG expressed as the CMYK color system and a metallic color that serve as second color space information, based on the image data ORG and the metallic ink addition information SA (the information of pixels to which the metallic ink S is to be added) determined by the metallic ink adding unit 35; and an image forming step of the image forming unit 38 generating the print data PORG based on the image data HORG obtained by performing a halftone process on the image data FORG obtained through the color conversion step. Accordingly, image data that uses the metallic ink S can be formed with ease without specifying where the metallic ink S is to be added, in accordance with the scene expressed by the image to be printed. In addition, because the metallic ink S is automatically used in locations where it is preferable to express a metallic sense in accordance with the scene expressed by the image to be printed, it is possible to obtain a visual effect (an appearance of metal) while suppressing costs more than in the case where the metallic ink S is used without regard for the scene expressed by the image to be printed.

Other Variations

This invention is not intended to be limited to the aforementioned embodiments, and in practice, various inventions can be obtained by varying and specifying the constituent elements thereof, combining as appropriate a plurality of constituent elements disclosed in the aforementioned embodiments, and so on without departing from the essential spirit of the invention. For example, although the aforementioned embodiments describe the first color space information of the image data ORG as color space information of the RGB color system and the second color space information as color space information for conversion into the CMYK color system and a metallic color, the color space information in the first color space information and the second color space information aside from the metallic color may employ color space information aside from the RGB color system (for example, the CIE color system, the XYZ color system, the L*u*v* color system, the L*a*b* color system, the Munsell color system, and so on). In addition, although the process for generating the metallic ink addition information SA shown in FIGS. 2 and 3 is described as being carried out prior to the color conversion process for output through the printer 10, this generation process may be carried out after the color conversion process.

Furthermore, some constituent elements described in the aforementioned embodiments may be omitted. Further still, the constituent elements belonging to different embodiments may be combined as appropriate.

What is claimed is:

1. A printing apparatus that prints an image based on an image data by using a special glossy ink and a color ink, the apparatus comprising:

a control unit that determines a scene of the image data, detects a specific object contained in the image data, when the determined scene is a night scene, and executes a printing that prints the image by the color ink, wherein, when the specific object is detected, the control unit executes the printing so as to add the special glossy ink to the specific object included in the image.

2. The printing apparatus according to claim 1, wherein the specific object is a moon.

3. The printing apparatus according to claim 1, wherein the specific object is neon signage.

4. The printing apparatus according to claim 1, wherein the specific object is a window in a building.

5. The printing apparatus according to claim 1, wherein the control unit executes the printing so that a color of the special glossy ink lightens as a distance increases from a pixel having a highest brightness in the specific object.

6. The printing apparatus according to claim 1, wherein the control unit detects the specific object by an image recognition technique, when the determined scene is the night scene.

7. A printing method that prints an image based on an image data by using a special glossy ink and a color ink, the method comprising:

determining a scene of the image data, detecting a specific object contained in the image data, when the determined scene is a night scene, and executing a printing that prints the image by the color ink, wherein, when the specific object is detected, executing the printing so as to add the special glossy ink to the specific object included in the image.

* * * * *